United States Patent [19]

Familant

[11] 3,973,387

[45] Aug. 10, 1976

[54] LOW DELIVERY TENSION PROCESS FOR PRODUCING CRIMPED YARN

[75] Inventor: Harold M. Familant, Pensacola, Fla.

[73] Assignee: Monsanto Company, St. Louis, Mo.

[22] Filed: Mar. 14, 1975

[21] Appl. No.: 556,231

Related U.S. Application Data

[63] Continuation-in-part of Ser. No. 461,064, April 15, 1974, abandoned.

[52] U.S. Cl. ..... 57/157 R

[51] Int. Cl.[2] ..... D01H 1/20; D01H 1/02

[58] Field of Search ..... 57/34 HS, 34 R, 51–51.5, 57/55.5, 75, 157 R, 157 TS, 157 S; 242/159

[56] References Cited

UNITED STATES PATENTS

| | | | |
|---|---|---|---|
| 3,081,593 | 3/1963 | Meerdink | 57/157 S |
| 3,279,164 | 10/1966 | Breen et al. | 57/157 TS |
| 3,462,938 | 8/1969 | Mehta | 57/157 TS |
| 3,589,120 | 6/1971 | Phillips | 57/157 S |
| 3,638,411 | 12/1969 | Tsugawa et al. | 57/34 HS |
| 3,651,633 | 3/1972 | Steinmiller | 57/157 TS X |
| 3,665,696 | 5/1972 | Gubinsky et al. | 57/157 R X |

*Primary Examiner*—Donald E. Watkins
*Attorney, Agent, or Firm*—Kelly O. Corley

[57] ABSTRACT

False-twist heat-set thermoplastic yarn having between 10 and 100 denier is collected on a pirn using a ring-and-traveller takeup mechanism at a balloon tension between 0.03 and 0.7 grams. The resulting yarn gives improved knitting performance and greatly reduced streakiness in hose and other knitted fabrics as compared to yarn collected at higher balloon tension.

20 Claims, 1 Drawing Figure

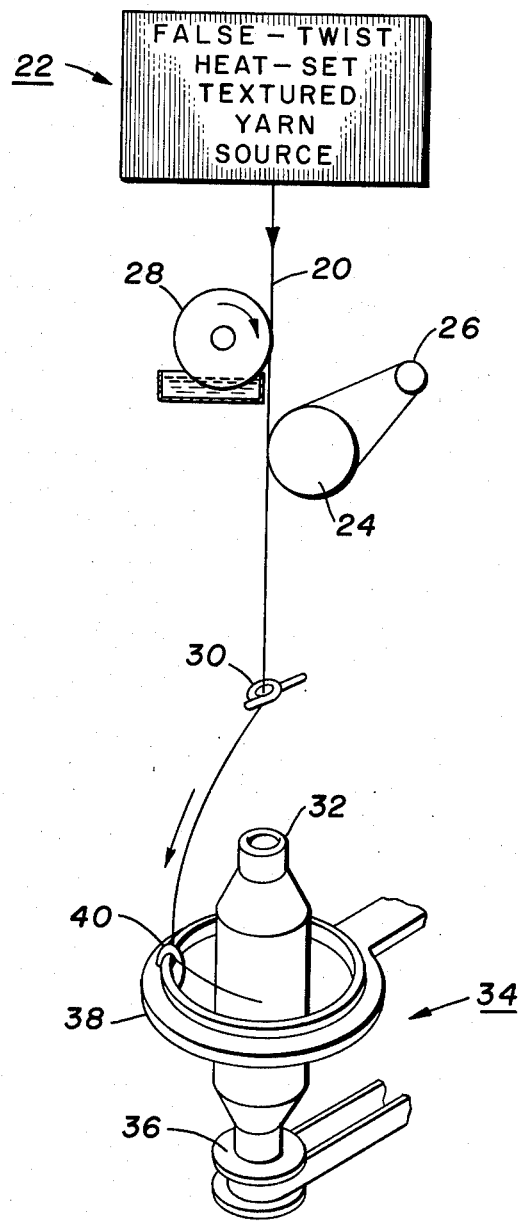
FALSE – TWIST
HEAT – SET
TEXTURED
YARN
SOURCE
22
28
20
26
24
30
32
40
38
34
36

LOW DELIVERY TENSION PROCESS FOR PRODUCING CRIMPED YARN

CROSS-REFERENCE TO RELATED APPLICATION

This application is a continuation in part of our copending application Ser. No. 461,064 which was filed on Apr. 15, 1974, now abandoned.

BACKGROUND OF THE INVENTION

The invention relates to a process for collecting false-twist heat-set yarn having a denier between 10 and 100 on a pirn under controlled tension. More particularly, it relates to such a process wherein the yarn properties are modified so as to give better knitting performance and superior quality in fabrics knitted from the yarn.

Yarns textured by the false-twist heat-set technique are referred to herein as "crimped yarns" for the sake of simplicity. Crimped yarns are customarily collected immediately following the texturing operation either on packages using a ring-and-traveller takeup mechanism which imparts twist to the yarn, such packages being referred to herein as pirns, or on bobbins without twist using a conventional winding mechanism to form "cheese" packages. The wound bobbin or cheese packages frequently cannot be used for directly feeding a knitting machine, necessitating repackaging the yarn onto cones prior to knitting. Pirn packages have different package formations and are more suitable for directly feeding a knitting machine due to lower and more uniform tension as the yarn is withdrawn overend by the knitting machine.

However, hosiery knitted from pirn packages heretofore have frequently suffered from visible vertical streaks, the streaks being more severe and objectionable when using heavy denier yarn than lighter denier yarn. It has been discovered that the streak problem can be substantially reduced or entirely eliminated by operating the ring-and-traveller takeup mechanism in a particular manner.

A primary object of the invention is to provide a pirn package of crimped yarn having properties such that hosiery knit from the crimped yarn exhibit little or no visible vertical streaks.

A further object is to provide a process for making a pirn package of the above character.

Other objects will in part appear hereinafter and will in part be obvious from the following detailed disclosure taken in connection with the accompanying drawing, in which the FIGURE is a schematic perspective view, partially in block diagram form, of the preferred apparatus for practicing the invention.

As shown in the FIGURE, crimped yarn 20 is produced by known false-twist heat-setting techniques by apparatus represented by box 22. Crimped yarn 20 is fed by delivery roll 24 and associated separator roll 26 at a constant speed to the yarn collection zone. Coning oil or other liquid finish optionally may be applied to yarn 20 by finish roll 28 in the high tension zone before roll 24, as illustrated. Alternatively, roll 28 may be located below delivery roll 24, and thus may be in the yarn collection (low tension) zone. Yarn 20 then passes through balloon guide 30 and is twisted and collected on pirn 32 by conventional ring-and-traveller takeup mechanism 34.

Mechanism 34 includes spindle 36 supporting pirn 32 for rotation, spindle 36 being driven at a controlled variable rate by conventional non-illustrated means.

Mechanism 34 further includes ring 38 and traveller 40 for distributing yarn 20 on pirn 32 to form the desired package. Traveller 40 is mounted for orbital movement on ring 38 while ring 38 is reciprocated parallel to the pirn axis between traverse limits which vary as the package is wound. Selection of the program controlling variation of the traverse limits is determined by the type of package desired. A number of exemplary programs are disclosed in U.S. Pat. No. 2,764,363, the disclosure of which is incorporated herein by reference. Particularly preferred programs are those wherein both traverse limits move upwardly as the package builds (referred to as "compound filling wound"), illustrated in FIGS. 7 and 8 in the noted patent, and those wherein the traverse limits converge as the package builds (warp wound), illustrated in FIG. 9 of the noted patent.

When collecting yarn on a pirn using a ring-and-traveller takeup or winding mechanism, it is difficult to determine the actual winding tension as the yarn goes onto the pirn. It is customary therefore to measure the yarn tension immediately above the balloon guide (referred to herein as balloon tension), and to control the winding process so as to maintain the balloon tension within certain limits. For ordinary drawn polyamide yarns, typical minimum balloon tensions are approximately 0.1 grams per denier. Somewhat lower tensions (as low as 0.05 grams per denier) are suggested in the special case of relaxed yarns by Pitzl in U.S. Pat. No. 3,003,222. However this reference teaches that satisfactory packages cannot be made at tensions lower than 0.06 grams per denier, and that 2 grams absolute is the lowest tension practicably usable for low denier yarns.

According to the invention, the balloon tension measured just above guide 30 is maintained at a value between 0.03 and 0.7 grams force, and preferably between 0.1 and 0.5 grams force. Not only does this produce a commercially acceptable process and package, contrary to the teachings in the prior art, but hose knit from the resulting package are substantially or entirely free of vertical streaks.

Generally speaking, the incidence and severity of streaks in hosiery knit from the yarn increase with balloon tension, and reach unacceptable levels when the balloon tension exceeds 0.6 grams force. Ordinarily, visible streaks are substantially entirely avoided when balloon tension does not exceed 0.5 grams tension. A practical lower limit to balloon tension is about 0.1 grams force, although tensions as low as about 0.03 grams force can sometimes be used.

While tension can be controlled by sensing balloon tension and controlling spindle speed using conventional feedback techniques, in the case of warp wound packages it is most conveniently accomplished by reducing spindle speed as the package diameter increases according to an empirically derived program. One exemplary mechanism suitable for controlling spindle speed and thus balloon tension according to a predetermined program is disclosed in U.S. Pat. No. 3,636,696, the disclosure of which is incorporated herein by reference.

In the preferred embodiment of the invention, 40 denier nylon 66 yarn having 13 filaments is textured on a Spinner V-VK machine with a speed at delivery roll 24 of 650 yarns (594 meters) per minute. Ring 38 is a Merriman porous sintered metal ring with a 5-⅜ inch (13.7 centimeters) diameter. Traveller 40 is a Coats and Clark style AR 586 RW, size 31, weighing 0.28 grains (0.018 grams). Using a pirn having a length of 13 inches (33 centimeters) and a diameter of 1-¾ inches (4.45 centimeters), initial spindle speed can be 5681 revolutions per minute. Spindle speed then decreases smoothly, reaching 5,388 r.p.m. after 23 minutes, 5123 r.p.m. after 46 minutes, 4955 r.p.m. after 68 minutes, etc. while forming a warp wound package. Under these conditions, balloon tension will be about 0.5 grams force tension. Ladies hosiery knit from the yarn are substantially free from vertical streaks.

For reasons which are not presently understood, the permissible range of balloon tensions is unexpectedly independent of denier over the range of 10 to 100 denier. For example, two samples of identically textured nylon 66 yarn having 20 denier and 7 filaments are collected with balloon tensions of 0.5 grams force, and 0.8 grams force respectively. Ladies hosiery knit from the yarn collected at 0.5 grams force balloon tension are substantially free from vertical streaks and are of excellent commercial quality, while ladies hosiery knit from the yarn collected with 0.8 grams force or more balloon tension contain numerous vertical streaks and are thus of considerably lower quality.

While the process is generally applicable to thermoplastic yarns as a class, the benefits derived therefrom are most evident when the yarns are formed from polyamides. The preferred polyamides, in turn, are the fiber-forming condensation product of hexamethylene diamine and adipic acid, commonly known as nylon 66, and the fiber-forming polymer formed from caprolactam, commonly known as nylon 6.

I claim:

1. In a continuous process wherein a thermoplastic yarn of between 10 and 100 denier is textured by false-twist heat-setting, the yarn then being fed at a given speed to a ring-and-traveller take-up mechanism comprising a spindle rotatably supporting and driving a pirn on which said yarn is to be collected, the improvement comprising rotating said spindle at a rate to maintain the balloon tension between 0.03 and 0.7 grams force.

2. The process defined in claim 1, wherein said balloon tension is maintained between 0.1 and 0.5 grams force.

3. The process defined in claim 1, wherein said yarn is a polyamide.

4. The process defined in claim 1, wherein a coning oil is applied to said yarn after said yarn is textured and before said yarn is collected on said pirn.

5. The process defined in claim 1, wherein said yarn is formed from nylon 66.

6. The process defined in claim 2, wherein said yarn is formed from nylon 66.

7. The process defined in claim 4, wherein said yarn is formed from nylon 66.

8. The process defined in claim 1, wherein said yarn is formed from nylon 6.

9. The process defined in claim 2, wherein said yarn is formed from nylon 6.

10. The process defined in claim 4, wherein said yarn is formed from nylon 6.

11. A pirn package produced by the process defined in claim 1.

12. A pirn package produced by the process defined in claim 2.

13. A pirn package produced by the process defined in claim 4.

14. A pirn package produced by the process defined in claim 5.

15. A pirn package produced by the process defined in claim 6.

16. The pirn package produced by the process defined in claim 7.

17. A warp wound pirn package produced by the process defined in claim 1.

18. A warp wound pirn package produced by the process defined in claim 2.

19. A warp wound pirn package produced by the process defined in claim 4.

20. A warp wound pirn package produced by the process defined in claim 5.

* * * * *